US007611238B2

(12) United States Patent
Nishida

(10) Patent No.: US 7,611,238 B2
(45) Date of Patent: Nov. 3, 2009

(54) IMAGE FORMING APPARATUS

(75) Inventor: Hajime Nishida, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 289 days.

(21) Appl. No.: 11/349,747

(22) Filed: Feb. 8, 2006

(65) Prior Publication Data

US 2006/0181589 A1 Aug. 17, 2006

(30) Foreign Application Priority Data

Feb. 14, 2005 (JP) ..... 2005-036142

(51) Int. Cl.
*B41J 2/01* (2006.01)
*B41J 29/38* (2006.01)

(52) U.S. Cl. ..... 347/104; 347/101; 347/16

(58) Field of Classification Search ..... 347/104, 347/101, 16

See application file for complete search history.

(56) References Cited

U.S. PATENT DOCUMENTS

| | | | | |
|---|---|---|---|---|
| 5,444,468 | A * | 8/1995 | Fukushima et al. | 347/14 |
| 5,531,436 | A * | 7/1996 | Ohyama et al. | 271/275 |
| 5,867,181 | A * | 2/1999 | Nakane et al. | 347/2 |
| 5,936,651 | A * | 8/1999 | Uchida et al. | 347/104 |
| 6,097,922 | A * | 8/2000 | Munenaka | 399/312 |
| 6,666,602 | B2 * | 12/2003 | Johnson | 400/624 |
| 6,786,590 | B2 * | 9/2004 | Maki et al. | 347/104 |
| 7,055,944 | B2 * | 6/2006 | Konishi | 347/100 |
| 7,264,347 | B2 * | 9/2007 | Maki et al. | 347/104 |
| 2002/0057322 | A1 * | 5/2002 | Tanikawa et al. | 347/103 |
| 2002/0126193 | A1 * | 9/2002 | Maki et al. | 347/104 |
| 2005/0195264 | A1 * | 9/2005 | Sootome et al. | 347/104 |

FOREIGN PATENT DOCUMENTS

| | | |
|---|---|---|
| JP | 4-201469 | 7/1992 |
| JP | 5-72824 | 3/1993 |
| JP | 7-267422 | 10/1995 |
| JP | 9-254460 | 9/1997 |
| JP | 10-29739 | 2/1998 |
| JP | 10-181935 | 7/1998 |
| JP | 2000-143026 | 5/2000 |
| JP | 2001-106377 | 4/2001 |
| JP | 2003-327343 | 11/2003 |
| JP | 2005-15227 | 1/2005 |

OTHER PUBLICATIONS

Dec. 26, 2008 official action in connection with a counterpart Japanese patent application No. 2005-036142.

* cited by examiner

*Primary Examiner*—Manish S Shah
*Assistant Examiner*—Leonard S Liang
(74) *Attorney, Agent, or Firm*—Cooper & Dunham, LLP

(57) ABSTRACT

An image forming apparatus includes a conveyance belt stretched around a plurality of rollers and carrying and conveying a recording medium to the image forming apparatus, at least one roller of the plural rollers being a driving roller rotationally driving the conveyance belt; and a pressing part configured to come in contact with the conveyance belt in an area where a surface of the conveyance belt moves, different from a conveyance area where the recording medium is carried, and configured to press the conveyance belt to the driving roller side so that the conveyance belt does not slip against the driving roller.

14 Claims, 14 Drawing Sheets

IMAGE FORMING APPARATUS

BACKGROUND

1. Technical Field

This disclosure relates to image forming apparatuses, and more particularly, to an image forming apparatus having a structure where a conveyance belt configured to carry and convey a recording medium is stretched around plural rollers and at least one roller among the plural rollers works as a driving roller which rotationally drives the conveyance belt.

2. Description of the Related Art

An inkjet printer has been known as an image forming apparatus wherein ink drops are jetted from a jet opening of a head so that an image is formed on the recording medium. In this inkjet printer, the ink drops jetted from the jet opening directly reach the surface of a paper so that an image is formed. Because of this, in order to realize a high quality image, it is necessary to improve the precision of a reaching position (position of contact) of the ink drop on the paper. As a method for improving the precision of the reaching position of the ink drop, the distance between the head and the paper is kept constant or paper conveyance is performed at high precision. As a method for carrying the paper at high precision, an image forming apparatus wherein a conveyance belt for conveying the paper to a position facing the head is electrostatically and evenly charged so that the paper is electrostatically adhered is disclosed in Japanese Laid-Open Patent Application Publications No. 4-2011469 and No. 9-254460.

FIG. 1 is a schematic view showing a main part of the related art image forming apparatus. As shown in FIG. 1, the related art image forming apparatus has a carriage 230 and a conveyance belt 231. The carriage 230 has a head 209. The conveyance belt 231 is stretched around a driving roller 232 and a tension roller 233 with a proper tension.

In addition, this image forming apparatus has a charging roller 237 and a pushing roller 236. A surface of the conveyance belt 231 is electrostatically charged by the charging roller 237. The paper is pushed onto the conveyance belt 231 at a position facing the driving roller 232 by the pushing roller 236.

The paper conveyed from a paper feeding tray or a manual tray (not shown) to the conveyance belt 231 is pushed onto the conveyance belt 231 by the pushing roller 236 so that the paper is electrostatically adhered to the conveyance belt 231. The paper electrostatically adhered to the conveyance belt 231 is conveyed to a position facing the head 209 by the conveyance belt 231.

A frictional force between the driving roller 232 and the conveyance belt 231 may be changed due to foreign particles coming in between the driving roller 232 and the conveyance belt 231 so that a slippage between the driving roller 232 and the conveyance belt 231 may happen. If the slippage happens, the paper electrostatically adhered to the conveyance belt 231 cannot be conveyed to the position facing the head 209 at good precision. As a result of this, the reaching position of the ink drop may be shifted so that a high quality image may not be formed.

For solving this problem, a pressing force of the pushing roller 236 applied to the conveyance belt 231 may be increased so that the slippage between the driving roller 232 and the conveyance belt 231 may be prevented. However, in this case, if the pressing force of the pushing roller 236 applied to the conveyance belt 231 is increased, it is difficult to for the paper to pass between the pushing roller 236 and the conveyance belt 231 so that paper jamming may happen.

Such a problem happens in not only the inkjet type image forming apparatus but also an image forming apparatus wherein a toner image is transferred onto a paper carried by the conveyance belt.

BRIEF SUMMARY

In an aspect of this disclosure, an image forming apparatus is provided whereby slippage of a conveyance belt and a driving roller can be prevented without causing a paper jam.

In an exemplary embodiment of this disclosure, an image forming apparatus includes a conveyance belt stretched around a plurality of rollers and carrying and conveying a recording medium to the image forming apparatus, at least one roller of the plural rollers being a driving roller rotationally driving the conveyance belt, and a pressing part configured to come in contact with the conveyance belt in an area where a surface of the conveyance belt moves, different from a conveyance area where the recording medium is carried, and configured to press the conveyance belt to the driving roller side so that the conveyance belt does not slip against the driving roller.

Since the conveyance belt is pressed to the driving roller side by the pressing part, slippage of the conveyance belt against the driving roller does not happen and therefore the recording medium can be conveyed to an image forming position at high precision. In addition, the pressing part comes in contact with the conveyance belt in an area, different from a conveyance area where the conveyance belt carries and conveys the recording medium, where a surface of the conveyance belt is moved. Because of this, it is possible to avoid having the recording medium carried by the conveyance belt pass between the pressing part and the conveyance belt. Therefore, it is possible to prevent the paper from jamming.

Other features, and advantages of the present invention will become more apparent from the following detailed description when read in conjunction with the accompanying drawings.

DETAILED DESCRIPTION OF THE PREFERED EMBODIMENTS

A description of examples and exemplary embodiments of the present invention is now given, with reference to FIG. 2 through FIG. 14.

Figure 1:
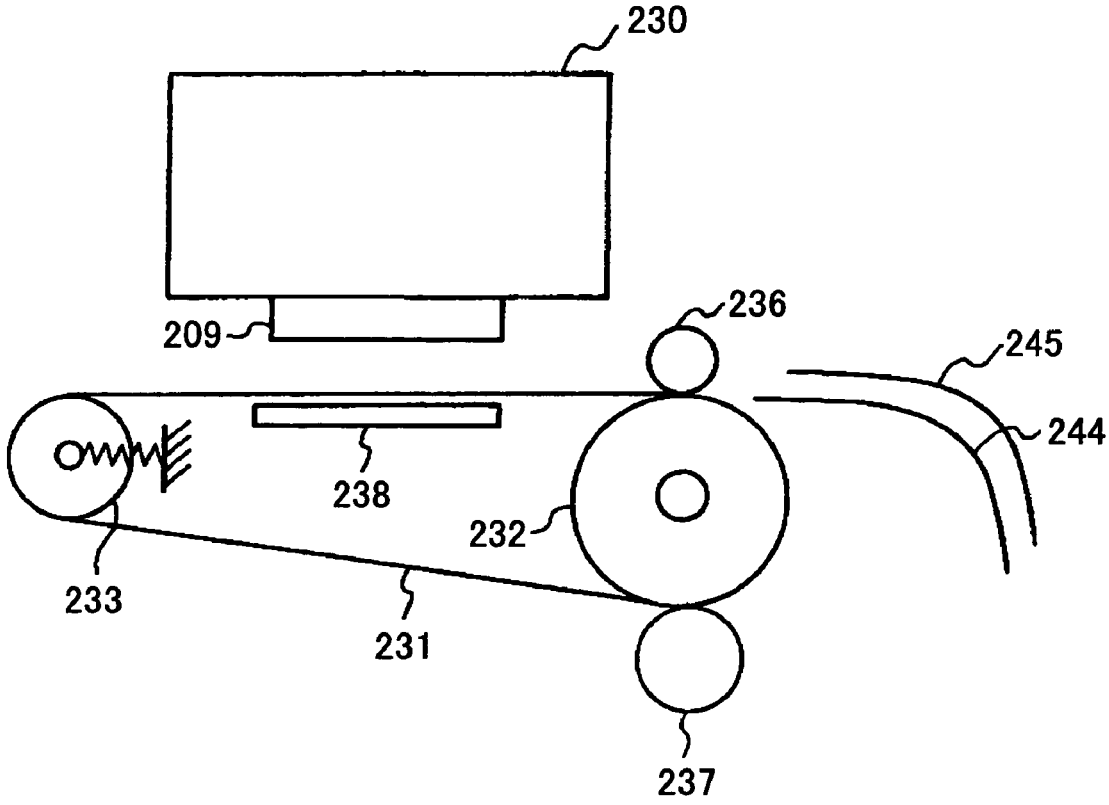
FIG. 1 is a schematic view showing a main part of the related art image forming apparatus.
Figure 2:
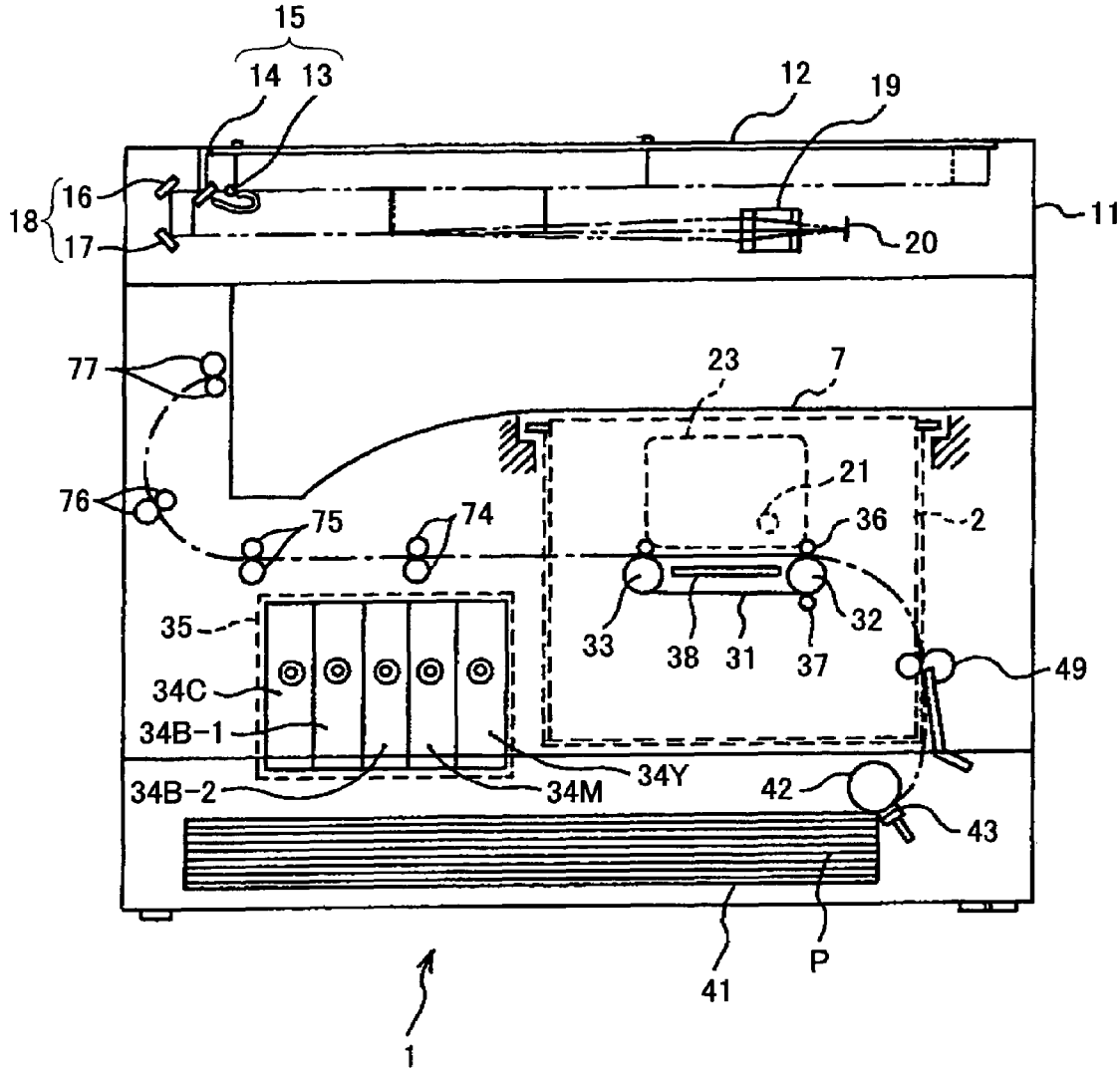
FIG. 2 is a schematic front view of an image forming apparatus of an embodiment of the present invention.

FIG. 2 is a schematic front view of an image forming apparatus in an exemplary embodiment of the present invention.

An image forming apparatus 1 includes an image forming unit 2 configured to form an image and a paper feeding cassette 41. The paper feeding cassette 41 can be attached to or detached from a front side of an apparatus main body 1. A large number of papers P are loaded and received in the paper feeding cassette 41. In addition, an image reading part 11 configured to read out a manuscript is provided at an upper part of the apparatus main body 1.

Figure 3:
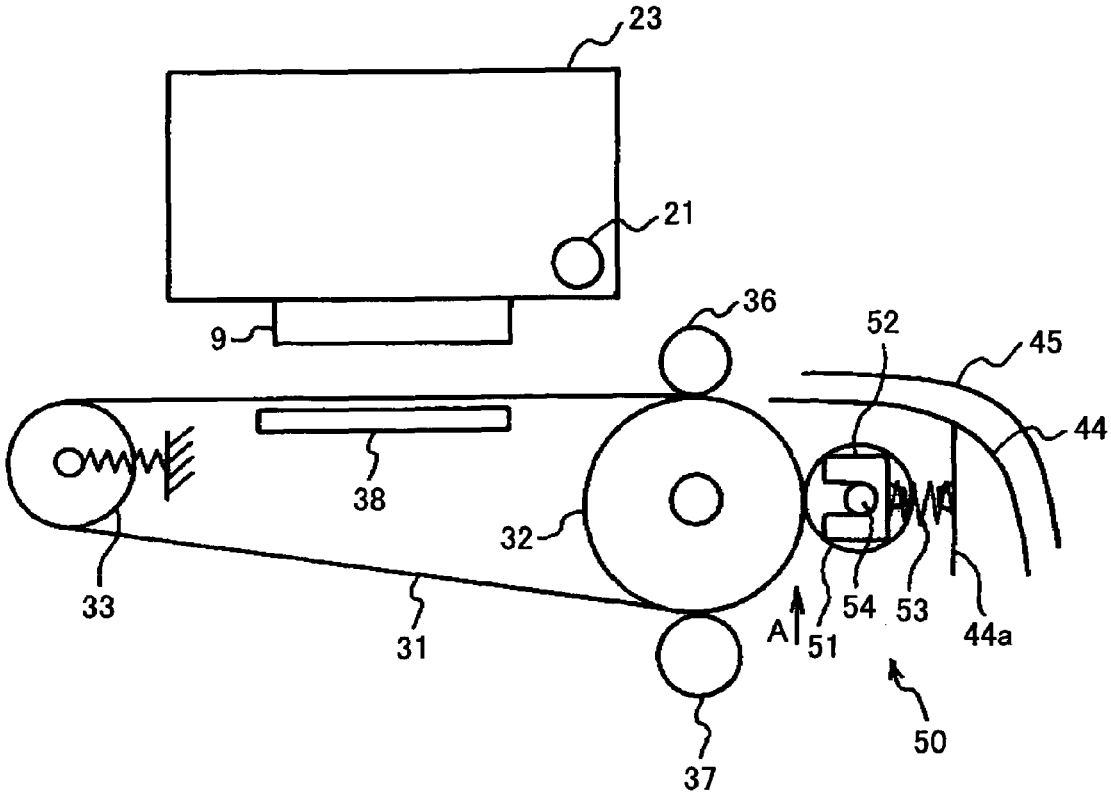
FIG. 3 is a schematic view of an image forming unit.

FIG. 3 is a schematic view of the image forming unit 2. As shown in FIG. 3, the above-mentioned image forming unit 2 includes a carriage 23 and a carriage guide 21 configured to guide the carriage 23. In the carriage 23, heads 9 having jet openings configured to jet ink liquid of yellow (Y), magenta (M), cyan (C), and black (B-1 and B-2) onto a paper are provided.

The image forming unit 2 includes a conveyance belt 31. The conveyance belt 31 is stretched around a driving roller 32 and a tension roller 33 by proper tension. The driving roller 32 is rotationally driven by a driving motor (not shown) at a designated rotational speed so that the conveyance belt 31 is also rotated at the designated rotational speed. In addition, the conveyance belt 31 includes a charging roller 37 configured to electrostatically charge a surface of the conveyance belt 31. A voltage from a high voltage power supply (not shown) is applied to the charging roller 37. Furthermore, the image forming unit 2 also includes a guide member (platen) 38 and a pushing roller 36. The guide member 38 guides the conveyance belt 31 in an area facing the head 9 in the image forming unit 2. The paper P is pushed onto the conveyance belt 31 at a position facing the driving roller 32 by the pushing roller 36. The image forming unit 2 also includes a lower guide member 44 and an upper guide plate 45 configured to guide the paper P. The image forming unit 2 is detachably provided to the apparatus main body 1.

A pressing part 50 configured to prevent a slip of the conveyance belt 31 is provided in the image forming unit 2. Here, only a basic structure of the pressing part 50 is discussed and a detailed structure of the pressing part 50 is discussed later.

The pressing part 50 includes a pressing roller 51, a bearing 52 and a spring 53. The pressing roller 51 applied a designated pressing force to the driving roller 32 via the conveyance belt 31. The pressing roller 51 comes in contact with the conveyance belt 31 in an area other than a conveyance area where the paper P is carried and conveyed by the conveyance belt 31. The contact surface of the pressing roller 51 is covered with a member having high insulating properties, such as rubber. Accordingly, transfer of an electric charge of the conveyance belt 31 charged by the charging roller 37 to the pressing roller 51 is prevented. The bearing 52 rotatably supports a rotational shaft 54 of the pressing roller 51. A spring support projection. 52*a* is provided at the bearing 52. One end of the spring 53 is held by the spring support projection 52*a*. Another end of the spring 53 is held by a spring support projection 44*b* provided at a support plate 44*a* of the lower guide member 44.

As shown in FIG. 2, a cartridge receiving part 35 configured to receive ink cartridges 34C, 34B-1, 34B-2, 34M, and 34Y is provided in the apparatus main body 1. Each of the ink cartridges 34C, 34B-1, 34B-2, 34M, and 34Y is connected to a supply pump (not shown). The ink liquid in the ink cartridge 34 is supplied to the carriage 23 by properly driving the supply pump. In addition, the ink cartridge 34 is detachably provided in the cartridge receiving part 35.

In the image reading part 11, a first moving body 15 and a second moving body 18 are provided to move in a reciprocating manner so that a manuscript (not shown) provided on a contact glass 12 is scanned and read. The first moving body 15 includes a light source 13 for illuminating the manuscript and a mirror 14. The second moving body 18 includes two mirrors 16 and 17. Image information scanned by the reading moving bodies 15 and 18 is read as an image signal by an image reading element 20, such as a CCD, provided behind the lens 19. The image signal read by the image reading element 20 is digitized and image-processed. Based on the image processing of the signal, the image is formed on the paper P by the above-discussed image forming unit 2.

The image forming apparatus can receive image data to be formed into an image by the image forming unit 2, from an external machine via a communication cable or a network. The image forming apparatus also processes the received image data so that image forming can be done. An information processing device such as a personal computer, an image reading apparatus such as an image scanner, a photographing apparatus such as a digital camera, or the like, can be used as the external machine configured to input the image data to be formed into an image by the image forming unit 2.

Next, an image forming operation of the image forming apparatus 1 of this embodiment is discussed.

First, the manuscript is placed on the contact glass 12 of the image reading part 11 and then a start switch (not shown) is pushed. As a result of this, the first moving body 15 and the second moving body 18 are moved and light is emitted from the light source 13 by the first moving body 15. At the same time, a reflection light from the manuscript is reflected so as to go to the second moving body 18. This reflection light coming from the manuscript to the second moving body 18 is reflected by a mirror of the second moving body 18 so as to enter the image reading element 20 via the lens 19. Manuscript contents are read by the image reading element 20 so that the image data are generated. Alternatively, the image data as the image information are sent from the external machine such as the personal computer (not shown) via the communication cable.

Then, the paper P is taken out from the paper feeding cassette 41. The papers P, one by one, are separated and carried by a separation roller 42 and a friction pad 43. The conveyed paper P is conveyed to the image forming unit 2 by paper feeding rollers 49. The paper P conveyed to the image forming unit 2 is pushed onto the conveyance belt 31 by the pushing roller 36. The surface of the conveyance belt 31 is electrostatically charged by the charging roller 37 so that the paper P is electrostatically adhered to the conveyance belt 31. The paper P being elastically absorbed is conveyed to a position facing the carriage 23 by the conveyance belt 31. When the paper P has reached the position facing the carriage 23, the conveyance belt 31 is stopped. While the carriage 23 is moved in a reciprocating manner in the main scanning line direction as corresponding to the image data, designated ink liquid is jetted to a designated part of the paper so that one line of an image is recorded on the paper P. Here, "one line" means an area in a sub-scanning line direction where the head 9 can record on the paper P when the paper P is stopped. After recording one line in the main scanning line direction is completed, the conveyance belt 31 is driven for a designated time and the paper is moved one line and then stopped. After that, while the carriage 23 is moved in a reciprocating manner in the main scanning line direction as corresponding to the image data, one line of the image is recorded on the paper P. By repeating such a process for a designated number of times, a desirable image is formed on the paper. The paper P where the desirable image is formed is conveyed to the paper discharge tray 7 by paper discharge trays 74, 75, 76 and 77 formed by paper discharge rollers and spurs.

Figure 4:
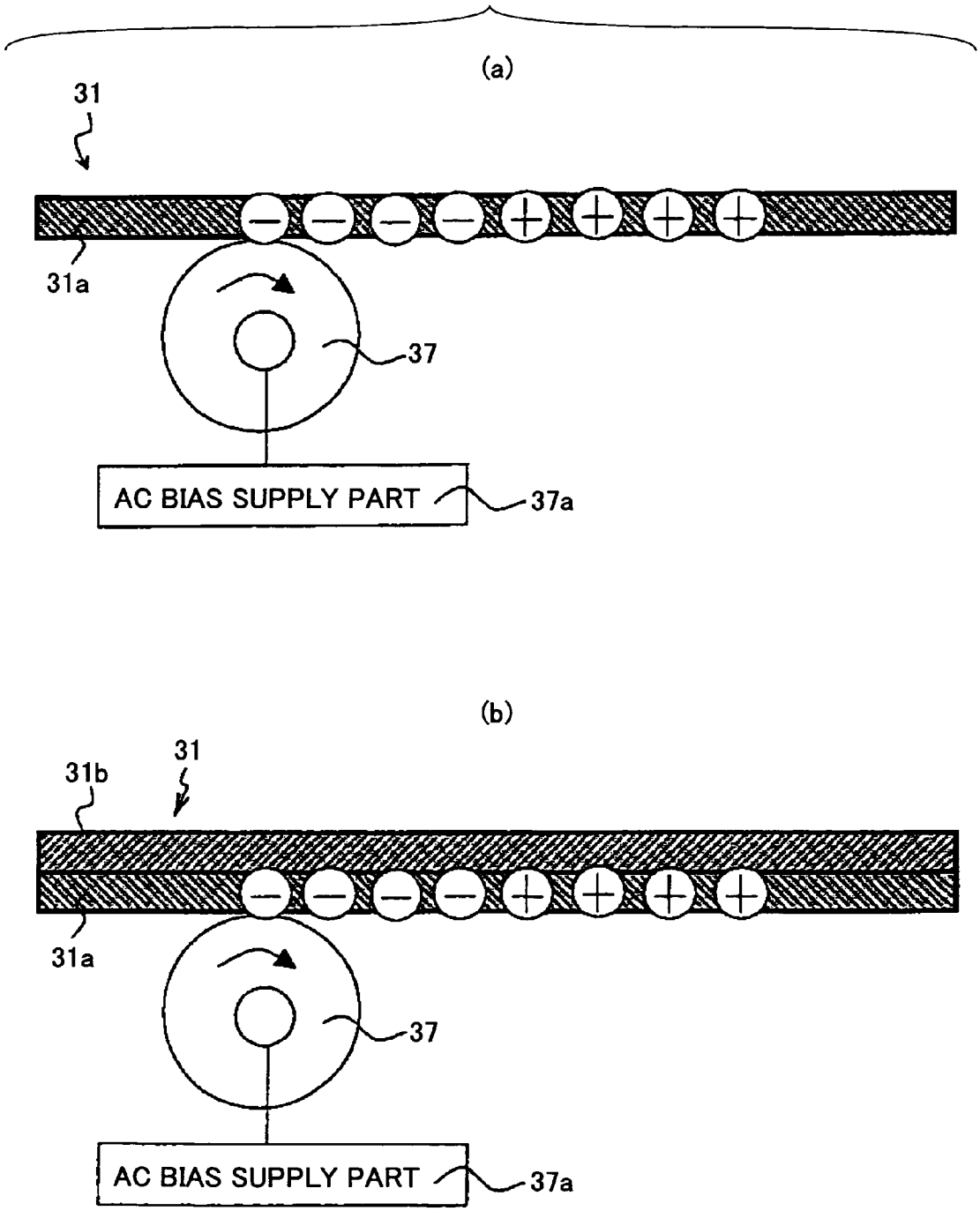
FIG. 4-(A) and FIG. 4-(B) is a cross-sectional view of the conveyance belt 31.

Next, details of the conveyance belt 31 are discussed. FIG. 4-(*a*) and FIG. 4-(*b*) is a cross-sectional view of the conveyance belt 31. The conveyance belt 31 may be an endless belt having a single-layer structure formed by only an insulation layer 31*a* as shown in FIG. 4-(*a*). The conveyance belt 31 may be an endless belt having a double-layer structure formed by the insulation layer 31*a* and a conductive layer 31*b* as shown in FIG. 4-(*b*). In a case of the conveyance belt 31 having the double-layer structure, the insulation layer 31*a* is an external circumferential surface coming in contact with the paper P and the conductive layer 31*b* is an internal circumferential surface coming in contact with the driving roller 32 and the tension roller 33. The conveyance belt 31 may be formed in an endless state by molding or by connecting both ends of the conveyance belt 31 by gluing. The insulation layer 31*a* is formed by resin such as PET, PEI, PVDF, PC, ETFE, or PTFE or an elastomer not including a conductive control material. It is preferable that the insulation layer 30 have a volume resistivity equal to or greater than $10^{12}$ [Ωcm] . More preferably, the insulation layer 30 has a volume resistivity of $10^{15}$ [Ωcm] . The conductive layer 31*b* is made of the same resin or elastomer as the insulation layer 31*a* and includes carbon as the conductive control member. The volume resistivity of the conductive layer 31*b* is $10^5$ through $10^7$ [Ωcm]. The conveyance belt 31 has a measurement in the width direction of 340 through 350 [mm] so that even an A3 size paper can be conveyed.

Figure 5:
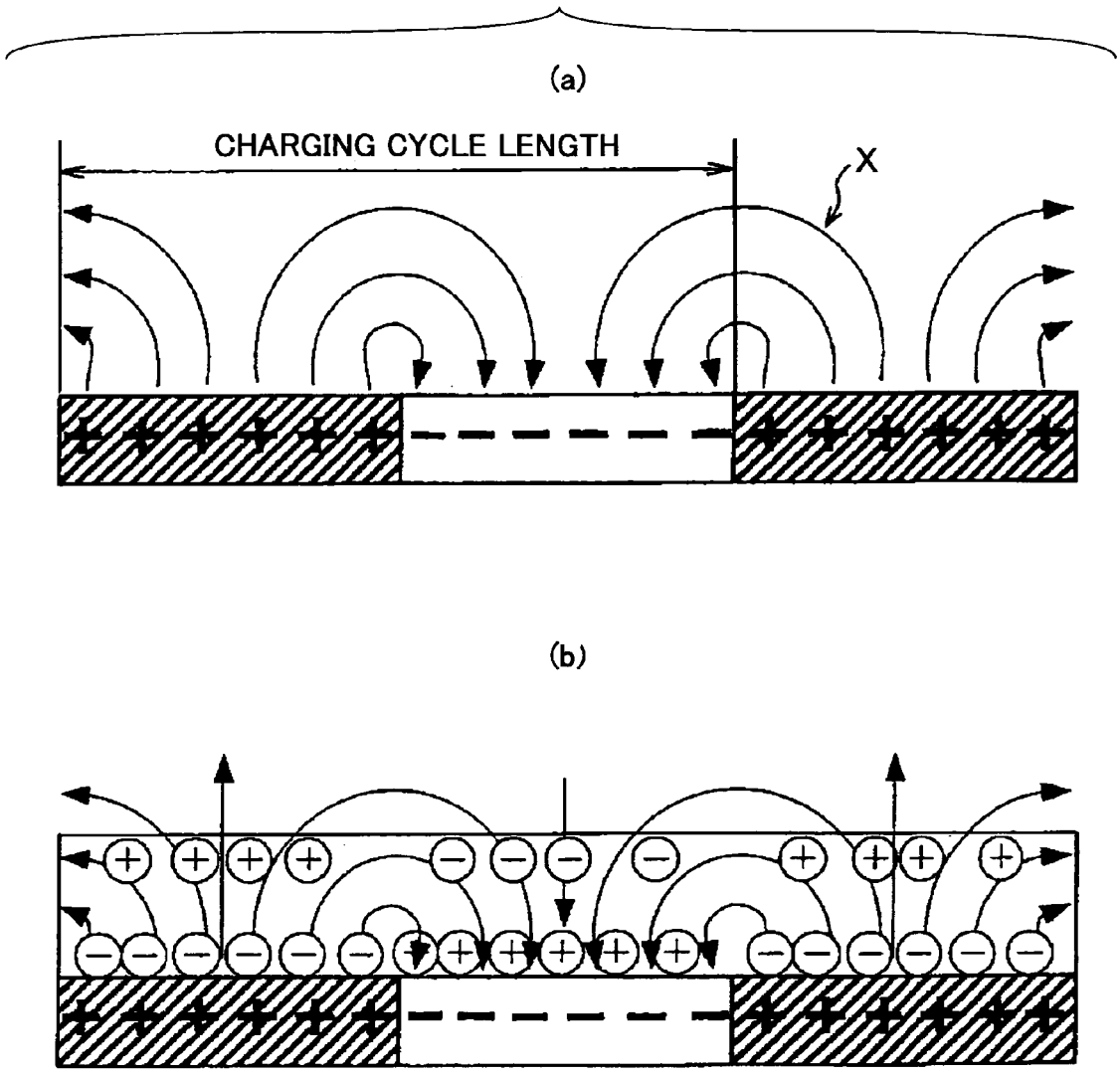
FIG. 5-(*a*) is a view showing an electrical field on the conveyance belt and FIG. 5-(*b*) is a view showing polarization of an electric charge of the paper.

The charging roller 37 is formed by a conductive member having a volume resistivity of $10^6$ through $10^9$ [Ωcm] . An AC bias supply part 37*a* configured to apply, for example, AC bias of±2 kV to the charging roller 37 is connected to the charging roller 37. The AC bias applied to the charging roller 37 may have various wave shapes such as a sine wave or a delta wave. However, it is preferable that the AC bias have a square wave. Voltages whose polarities are different are mutually applied to the insulation layer 31*a* of the conveyance belt 31 by the charging roller 37 so that electric charges whose polarities are different are mutually accumulated on the insulation layer of the conveyance belt 31. As a result of this, as shown in FIG. 5-(*a*), a minute electrical field X, being generated from a positive electric charge on the conveyance belt in a direction perpendicular to the conveyance belt 31 and curved on the way so as to go to a negative electric charge, is generated on the conveyance belt 31. Since the insulation layer 31*a* has a volume resistivity equal to or greater than $10^{12}$ [Ωcm] , the positive and negative electric charges accumulated on the insulation layer 31*a* do not move and do not cancel each other. Therefore, it is possible to mutually obtain stable positive and negative electric charges on the conveyance belt 31.

When the paper conveyed from the paper feeding tray 41 is conveyed to the conveyance belt 31, as shown in FIG. 5-(*b*), dielectric polarization of the paper is generated by the electric field X generated from the conveyance belt 31. Electric charges having reversed polarization compared to polarization on the conveyance belt 31 are generated at a conveyance belt side of the paper so that the paper is elctrostatically adhered on the conveyance belt 31.

On the other hand, influence of the electrical field emanating from the conveyance belt 31 at a printing surface side of the paper is small. Because of this, the amount of the electric charge generated by the electrical field of the conveyance belt 31 at the printing surface side of the paper is smaller than the amount of the electric charge generated at the conveyance belt side. The reason of this is as follows.

The electrical field form the conveyance belt 31 is curved in an arc shape above the conveyance belt 31. Because of this, the electrical field in the vicinity of a border of a part positively charged and a part negatively charged of the conveyance belt 31 is parallel to the paper so that an electrical potential is not generated at the printing surface of the paper P. As a result of this, an electric charge is not induced at the printing surface of the paper P positioned in the vicinity of a border of a part positively charged and a part negatively charged of the conveyance belt 31. Accordingly, the amount of the electric charge induced at the printing surface of the paper is smaller than the amount of the electric charge induced at the conveyance belt 31. After time passes, a true electric charge having charging polarization different from the charging polarization on the conveyance belt 31 gradually move from an inside of the paper to the conveyance belt side of the paper. In addition, at the same time, a true electric charge having charging polarization the same as charging polarization on the conveyance belt 31 gradually move from an inside of the paper to the printing surface side of the paper.

Although the surface resistivity of the paper is $10^{11}$ through $10^{13}$[Ω], since the surface is conductive, the true electric charge moving the printing surface side is unstable. Because of this, as time passes, the true electrical charge at the printing surface side of the paper attracts the opposite polarization and disappears so that the electrical potential at the paper printing surface side is reduced. On the other hand, a strong electrical field is applied from the conveyance belt to the conveyance belt side of the paper. Therefore, unlike the printing surface side of the paper, the true electric charge is not canceled and does not disappear. Thus, since the true electric charge does not exist at the printing surface side of the paper, an electrostatic attraction force between the paper and the conveyance belt is heightened. In addition, the true electric charge at the printing surface side of the paper is canceled so that the electrical potential at the printing surface side of the paper is lowered. As a result of this, an electrical field is not generated between the head of the printing surface side of the paper and therefore a shift of the position on the paper where the ink drop jetted from the head reaches, due to the influence of the electrical field, is not generated. Furthermore, it is possible to prevent ink mist from adhering to the head.

Figure 6:
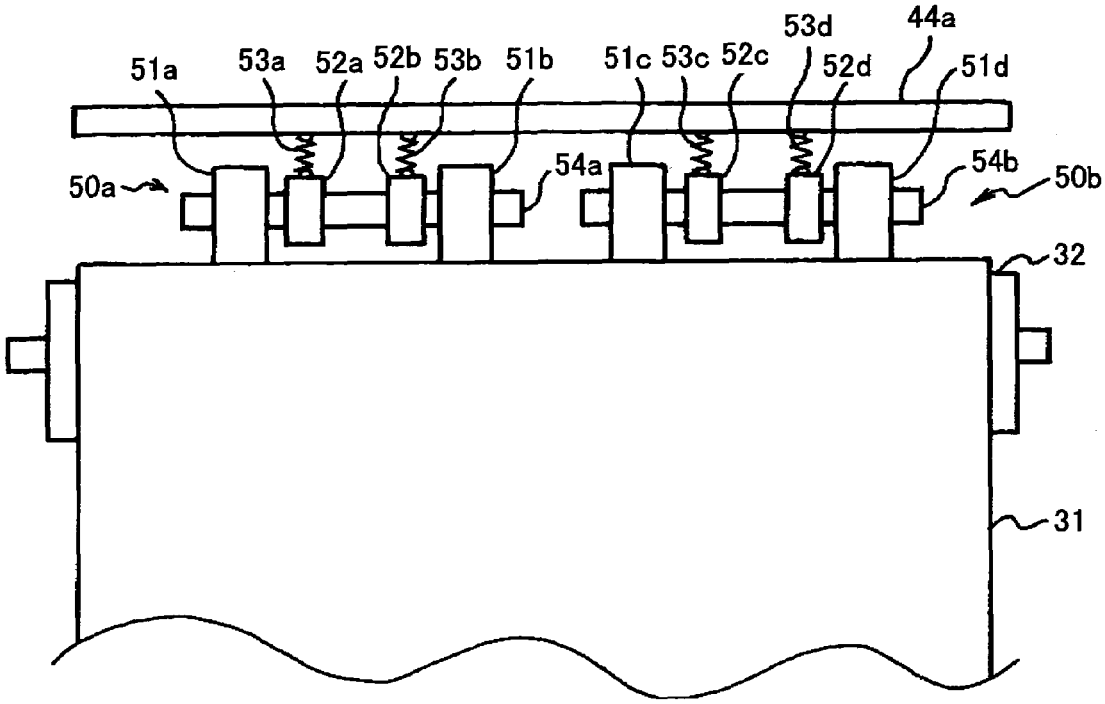
FIG. 6 is a view of the image forming unit seen in an A direction in FIG. 3.

Next, details of a structure of the pressing part 50 are discussed. FIG. 6 is a view of the image forming unit seen in an A direction in FIG. 3. As shown in FIG. 6, the pressing part 50 includes a first pressing part 50*a* and a second pressing part 50*b*. The first pressing part 50*a* presses a left side in FIG. 6 of the conveyance belt 31. The second pressing part 50*a* presses a right side in FIG. 6 of the conveyance belt 31. The first pressing part 50*a* includes a first rotational shaft 54*a*, and a first pressing roller 51*a* and a second pressing roller 51*b* attached to the first rotational shaft 54*a*. The first rotational shaft 54*a* is supported by a first bearing 52*a* and a second bearing 52*b*. The first bearing 52*a* is supported by a support plate 44*a* of a lower guide plate via a spring 53*a*. The second bearing 52*b* is supported by the support plate 44*a* of the lower guide plate via a spring 53*b*. The first pressing roller 51*a* and the second pressing roller 51*b* are pressed to a belt side by the springs 53*a* and 53*b* so that the conveyance belt 31 is pressed with the designated pressing force.

The second pressing part 50*b* configured to press a right side of the conveyance belt 31 has a structure similar to the structure of the first pressing part 50*a*. Two pressing rollers, a third pressing roller 51*c* and a fourth pressing roller 51*d*, configured to press the conveyance belt 31, are provided at a second rotational shaft 54*b*. The second rotational shaft 54*b* is supported by two bearings, a third bearing 52*c* and a fourth bearing 52*d*. The third bearing 52*c* is supported by the support plate 44*a* of the lower guide plate via a third spring 53*c*. The fourth bearing 52*d* is supported by the support plate 44*a* of the lower guide plate via a fourth spring 53*d*. The third pressing roller 51*c* and the fourth pressing roller 51*d* are pressed to the belt side by the springs 53*c* and 53*d* so that the conveyance belt 31 is pressed with the designated pressing force.

The pressing forces of the pressing rollers 51*a* through 51*d* acting on the conveyance belt 31 are greater than the pressing force of the charging roller 37 acting on the conveyance belt 31 or the pressing force of the pushing roller 36 acting on the conveyance belt 31. If the pressing forces of the pressing rollers 51*a* through 51*d* acting on the conveyance belt 31 are smaller than the pressing force of the charging roller 37 acting on the conveyance belt 31 or the pressing force of the pushing roller 36 acting on the conveyance belt 31, the slippage between the driving roller 32 and the conveyance belt 31 cannot be prevented by the pressing rollers 51. If the pressing force of the pushing roller 36 is great so that the slippage between the driving roller 32 and the conveyance belt 31 can be prevented, the following problems happen. That is, the paper P guided and conveyed by the lower guide pate 44 and the upper guide plate 45 cannot pass between the pushing roller 36 and the conveyance belt 31 so that paper jamming is generated. In addition, if the pressing force of the charging roller 37 is great so that the slippage between the driving roller 32 and the conveyance belt 31 can be prevented, the conveyance belt cannot be charged well depending on the material quality of the conveyance belt 31. As discussed above, in a case where the pressing force of the pressing roller 51 is greater than the pressing forces of the charging roller 37 and the pushing roller 36, it is possible to prevent the slippage between the driving roller 32 and the conveyance belt 31 without damaging the charging properties of the conveyance belt 31 or generation of a paper jam.

It is preferable that the pressing rollers 51*a* through 51*d* not provided on the conveyance path of the paper P. The pressing rollers 51*a* through 51*d* push the conveyance belt 31 to the side of the driving roller 32 with an extremely high pressure so that the slippage between the driving roller 32 and the conveyance belt 31 can be prevented. Because of this, if the pressing rollers 51*a* through 51*d* are provided on the conveyance path, the paper P cannot easily pass between the pressing rollers 51*a* through 51*d* and the conveyance belt 31 so that a paper jam may happen. Therefore the paper jamming can be prevented by not providing the pressing rollers 51*a* through 51*d* on the conveyance path of the paper P.

It is preferable that the pressing roller 51 come in contact with an area of 15 through 50 [mm] from a center line in a conveyance belt width direction to end parts.

Figure 7:
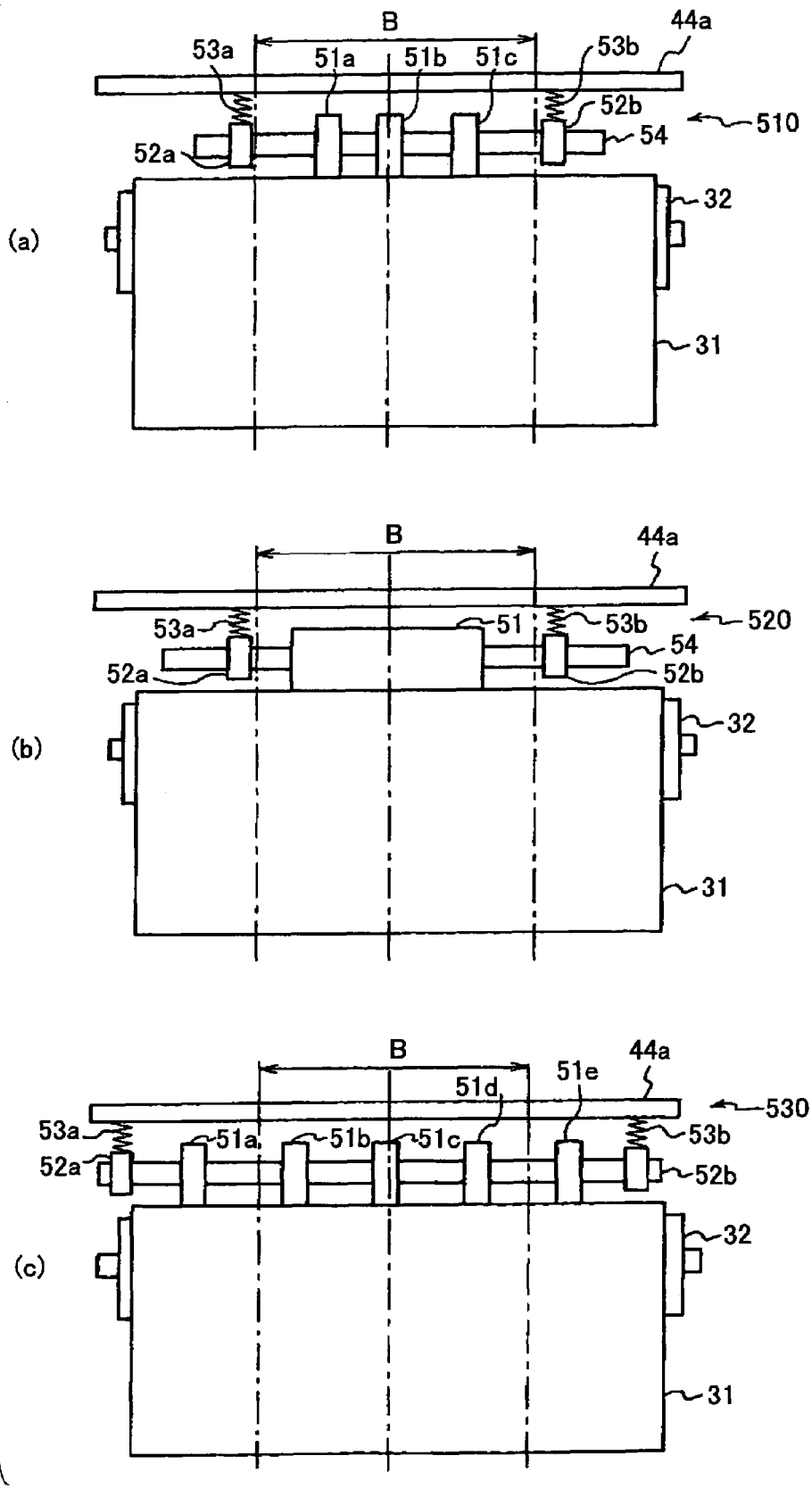
FIG. 7 is a view showing other example of the pressing part.

FIG. 7-(*a*) is a view of the pressing part 510 wherein plural pressing rollers 51*a*, 51*b*, and 51*c* come in contact within an area B of the conveyance 15 through 50 [mm] from the center line in the conveyance belt width direction to end parts. FIG. 7-(*b*) is a view of a pressing part 520 wherein a pressing roller 51 long in the belt width direction comes in contact within the area B. FIG. 7-(*c*) is a view showing an example where the pressing roller 51 is provided within an area other than the area B. For example, as shown in FIG. 7-(*c*), in a case where the pressing rollers 51*a* through 51*e* are evenly provided in the belt width direction, due to precision of parts such as de-centering of the shaft, the pressure of the pressing roller 51*e* at the right end to the conveyance belt 31 may be different from the pressure of the pressing roller 51*a* at the left end to the conveyance belt 31. Thus, if the pressures to the conveyance belt 31 are different between the right end and the left end, a twist of the belt may happen. However, as shown in FIG. 7-(*a*), by making contact with the pressing rollers 51*a* through 51*c* within the area B, even if the de-centering of the shaft exists, a pressure of the pressing roller 51*e* at the right end to the conveyance belt 31 may not be greatly different from the pressure of the pressing roller 51*a* at the left end to the conveyance belt 31.

Since the distance between the pressing roller 51*c* at the right end and the pressing roller 51*a* of the left end is shorter than the distance shown in FIG. 7-(*c*), the difference of the pressing forces between the left and right ends of the belt is small as compared with the pressing part shown in FIG. 7-(*c*). Because of this, as shown in FIG. 7-(*a*), the pressing roller comes in contact with the area B so that the center of the belt is pressed in a concentrated manner and thereby the twisting of the belt can be prevented more as compared with the pressing part shown in FIG. 7-(*c*). In addition, as shown in FIG. 7-(*b*), even if the pressing roller 51 long in the belt width direction comes in contact within the area B, the difference of the pressing force between the left and right ends of pressing roller 51 is not great so that the twisting of the belt can be prevented.

Figure 8:
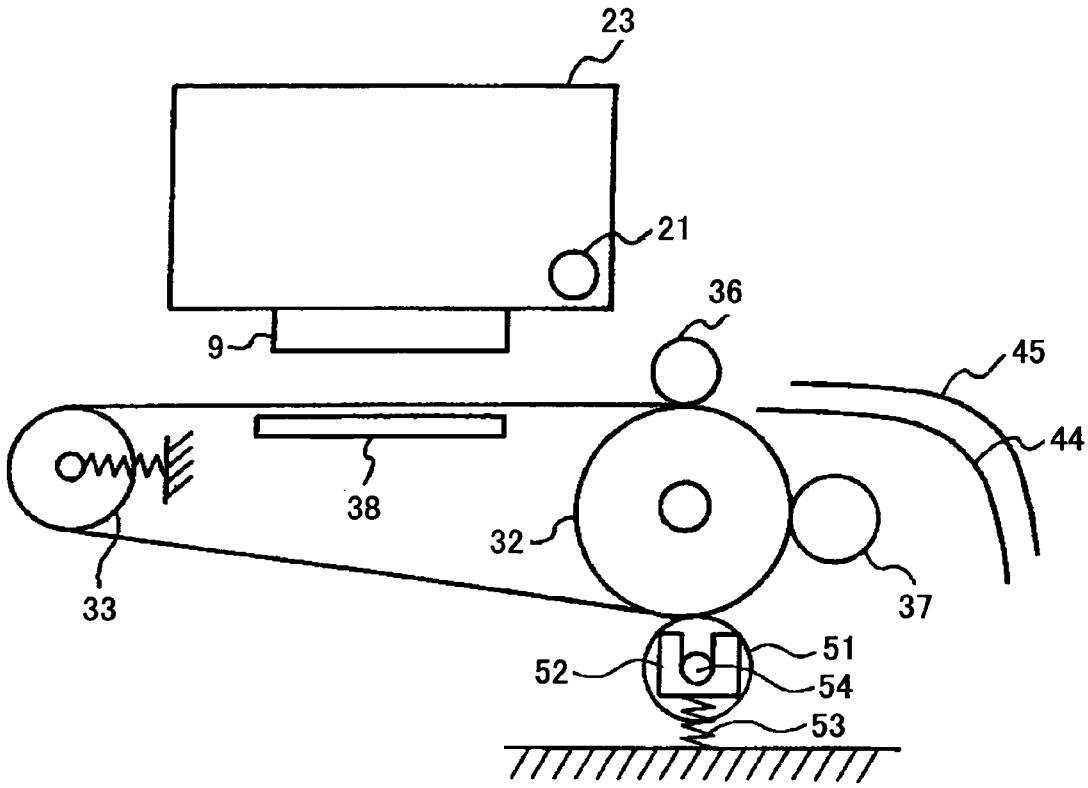
FIG. 8 is a schematic view of an example where a charging roller is provided further downstream in a moving direction of the conveyance belt than the pressing part.

In addition, as shown in FIG. 8, the position of the pressing roller 51 may be switched to the position of the charging roller 37. As shown in FIG. 8, the electric charge charged transferred to the conveyance belt 31 by the charging roller 37 may not be removed by the pressing roller 51 if the pressing roller 51 is provided at an upstream side against the moving direction of the conveyance belt 31 further than the charging roller 37. Because of this, it is possible to electrostatically adhere the paper as compared with a case where the pressing roller 51 is provided at the downstream side in the moving direction of the conveyance belt 31 further than the charging roller 37.

In addition, in this embodiment, encoders are provided at the pressing roller 51 and the driving roller 31 so that the rotational amount of the pressing roller 51 and the rotational amount of the driving roller 32 are compared. A slip measuring part configured to measure the amount of slip of the conveyance belt 31 based on the result of this comparison is provided.

Figure 9:
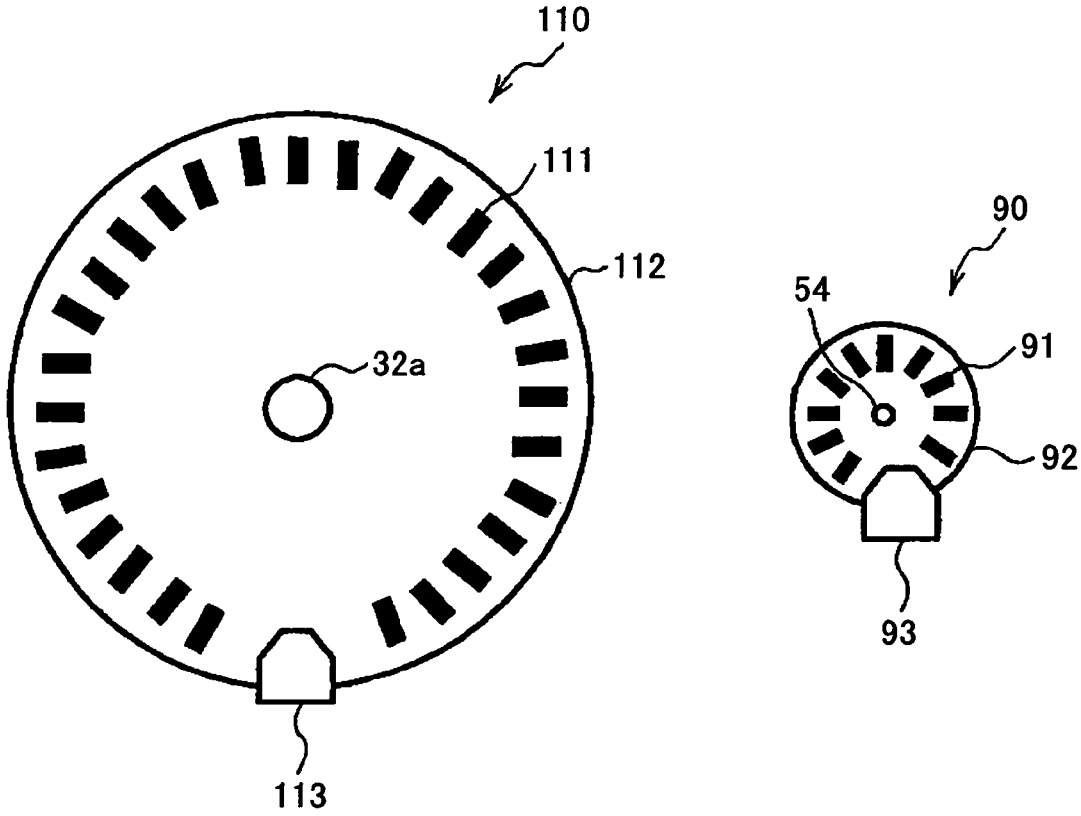
FIG. 9 is a schematic view of an example of an encoder sensor provided in the pressure roller.

FIG. 9 is a view showing an example of a pressing roller side encoder sensor 90 provided at the pressing roller 51 and a driving roller side encoder sensor 110 provided at the driving roller 32. As shown in FIG. 9, the pressing roller side encoder sensor 90 includes a pressing side encoder disk 92 where plural slits 91 are provided on the circumference and a pressing side light reflection type sensor 93. The pressing side encoder disk 92 is formed by a member having a high reflection rate such as metal and is provided at the rotational shaft 54 of the pressing roller 51. The pressing side light reflection type sensor 93 is provided so as to face the slits 91 of the pressing side encoder disk 92. When the pressing side encoder disk 92 is rotated so that the slits 91 pass through the pressing side light reflection type sensor 93, a pulse signal is output from pressing side light reflection type sensor 93 to a control part of the image forming apparatus. By counting the pulse signals by the control part, the rotation numbers of the pressing roller is measured.

The driving roller side encoder sensor 110 has a similar structure to the structure of the pressing roller side encoder disk 90. In other words, the driving side encoder disk 112 having a structure where plural slits 111 are provided at the circumference is mounted on the rotational shaft 32*a* of the driving roller. A driving side light reflection type sensor 113 is provided so as to face the slits 111. When the slits 111 pass through the driving side light reflection type sensor 113, the pulse signal is sent from the driving side light reflection type sensor 113 to the control part. By the control part counting this pulse signal, the rotation number of the driving roller 32 is measured.

The gap between of the slits 91 of the pressing roller side encoder sensor is the same as the gap between the slits 111 of the driving roller side encoder sensor. Because of this, the moving distance of an optional portion at the external circumferential surface of the driving roller until the driving side light reflection type sensor 113 detects the next slit 111 after detecting a slit 111, is the same as the moving distance of an optional potion at the external circumferential surface of the pressing roller until the pressing side light reflection type sensor 93 detects the next slit 91 after detecting a slit 91. Because of this, in a case where there is no slip between the belt and the driving roller, the pulse number being output by the driving roller side encoder sensor 110 is the same as the pulse number being output by the pressing roller side encoder sensor 90 attached to the pressing roller rotating with the belt.

On the other hand, if there is a slippage at the conveyance belt 31, the moving distance of the external circumference of the pressing roller 51 rotating with the belt is shorter than the moving distance of the external circumference of the driving roller 32. Because of this, the pulse number being output by the pressing roller side encoder sensor 90 attached to the pressing roller rotating with the belt is smaller than the pulse number being output by the driving roller side encoder sensor 110. In other words, the difference between the pulse number being output by the pressing roller side encoder sensor 90 attached to the pressing roller rotating with the belt and the pulse number being output by the driving roller side encoder sensor 110 is measured as a sliding amount of the conveyance belt 32 and the driving roller 31.

In addition, the pressing roller side encoder sensor 90 and the driving roller side encoder sensor 110 are not limited to the above-mentioned sensors. A transmission sensor may be used as the pressing roller side encoder sensor 90 and the driving roller side encoder sensor 110. In this case, the encoder disk is made of material having a low reflection rate and put between a light receiving element and a light emitting element. When the slit of the encoder disk passes through the transmission type sensor, light from the light emitting sensor is detected by the light receiving sensor and the pulse signal is output to the control part. The encoder may be a magnetic type. In the magnetic type encoder, a magnetic member, instead of a magnetic member, is attached to the encoder disk. The magnetic sensor is provided at a position facing the magnetic member. When the magnetic member passes through the magnetic sensor, the magnetic sensor detects the magnetic member so as to output the pulse signal to the control part.

The rotation number at the driving roller side is determined from the rotation number of the driving roller so that the encoder sensor at the driving roller side can be eliminated. Thus, when the rotation number is used, the diameter of the driving roller 32 and the diameter of the pressing roller 51 are recorded in advance. In addition, the count number of the pulse signal being output from the encoder sensor 90 at the pressing roller side when the pressing roller 51 rotates one time is recorded in advance. The moving distance of the external circumferential surface of the driving roller 32 is calculated by the rotation number and the diameter of the driving roller 32. At the pressing roller side, the rotation number of the pressing roller 51 is calculated by the count number of the pulse signal of the encoder sensor 90 and the count number recorded in advance of a single rotation of the pressing roller 51. The moving distance of the external circumferential surface of the pressing roller is calculated by the rotation number of the pressing roller 51 and the diameter of the pressing roller. The slip amount of the conveyance belt is measured by subtracting the moving distance of the external circumferential surface of the pressing roller from the moving distance of the external circumferential surface of the driving roller.

Figure 10:
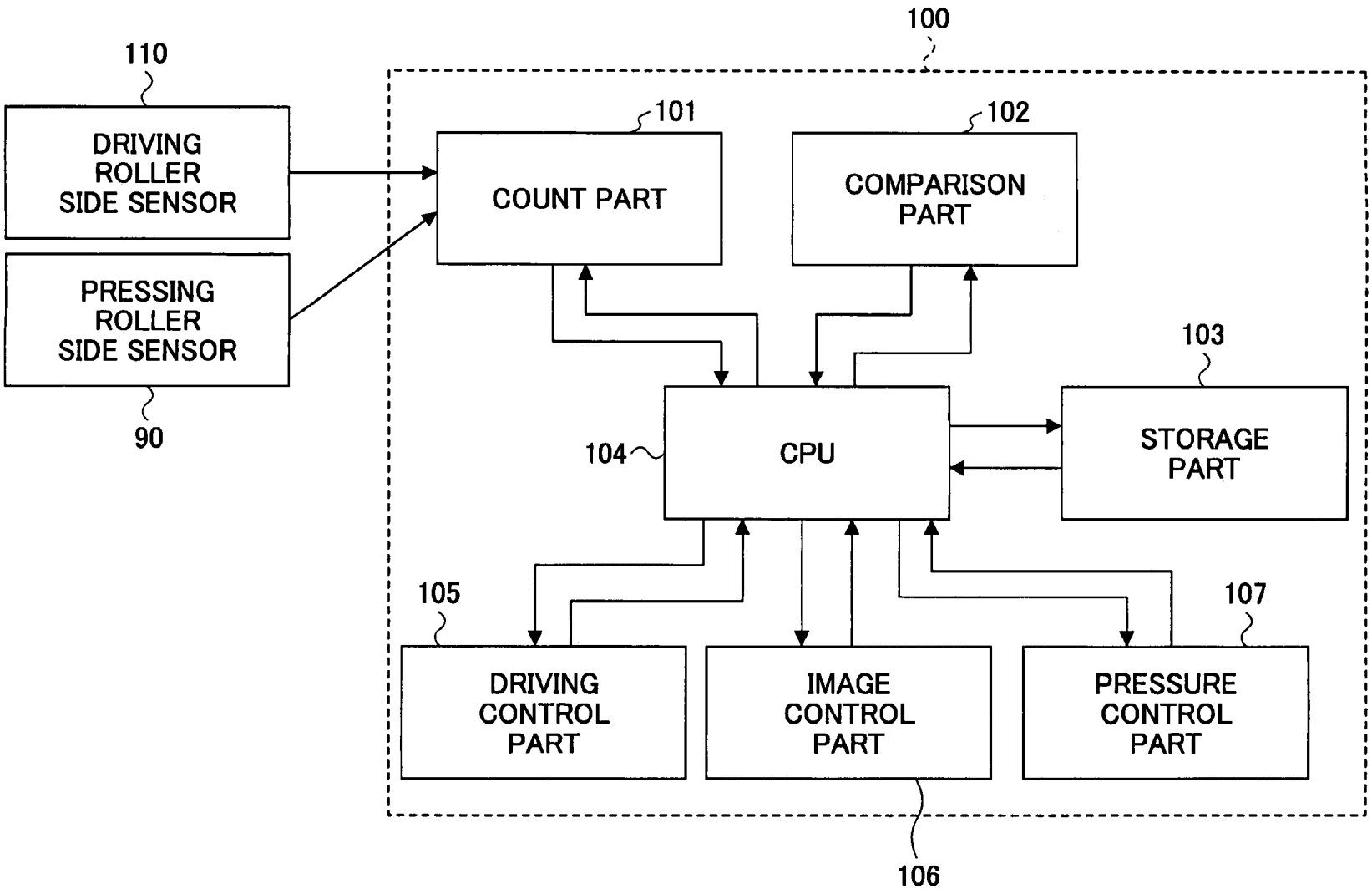
FIG. 10 is a control block diagram of a slip measuring part.

FIG. 10 is a control block diagram of a slip measuring part. As shown in FIG. 10, the control part 100 of the image forming apparatus includes a count part 101, a comparison part 102, a storage part 103, a CPU 104, a driving control part 105, an image control part 106, and a pressing control part 107. The count part 101 counts the pulse signal being output from the driving roller side encoder sensor 110 so that the rotation number of the driving roller 32 is measured. In addition, the count part 101 counts the pulse signal being output from the pressing roller side encoder sensor 90 so that the rotation number of the pressing roller 51 is measured. The comparison part 102 compares the rotation number of the driving roller 32 (count number) and the rotation number (count number) of the pressing roller 51 so that the slip amount of the conveyance belt 31 is calculated. The storage part 103 stores a pressing table formed by relating the pressing force applied to the pressing roller 51 and the count number of the pressing roller 51. The CPU 104 send control information based on the comparison result by the comparison part 102 to a driving control part 105 configured to control driving of the conveyance belt 31, the image control part configured to control the image forming operation, and the pressing control part 107 configured to control the pressing force of the pressing roller 51.

Figure 11:
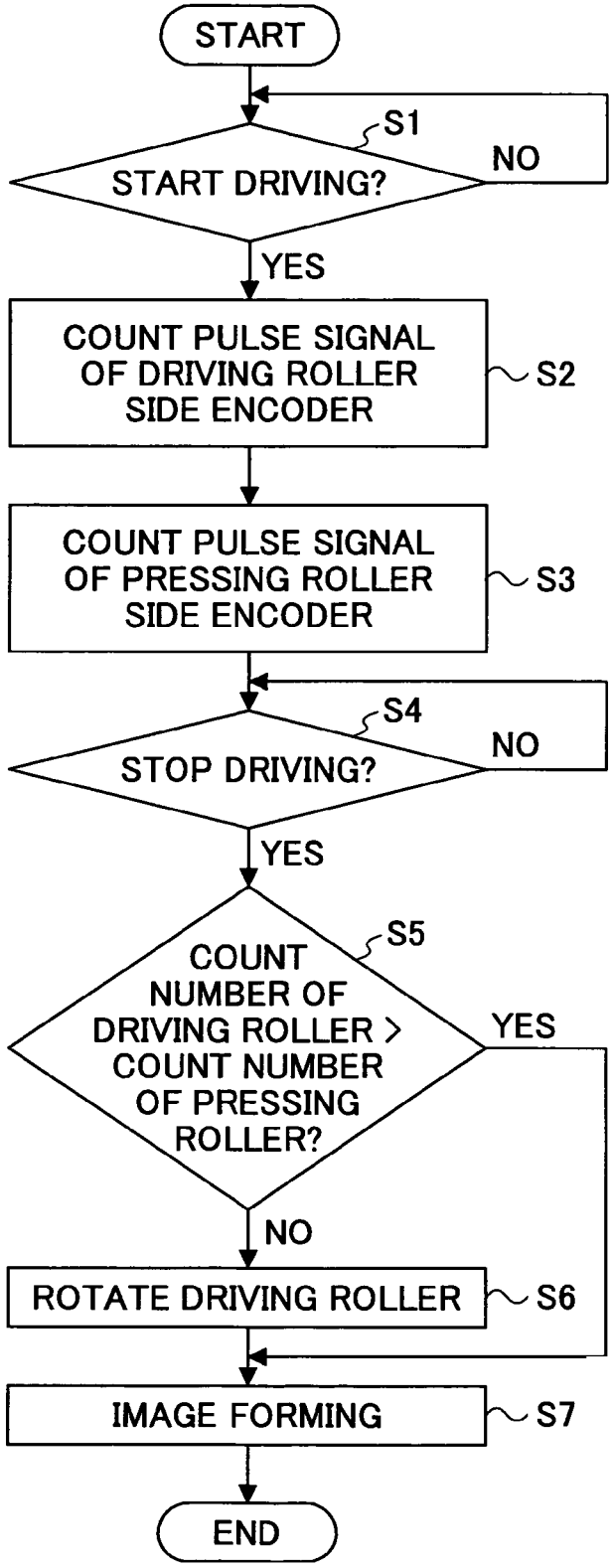
FIG. 11 is a flowchart of a paper position correction control.

In this embodiment, the slip amount is calculated by the comparison part 102 and a gap at a position where image forming at the paper starts due to the belt slip is corrected based on the slip amount. Next, a control for this correction is discussed. FIG. 11 is a flowchart of a paper position correction control. As shown in FIG. 11, in step 1, the image forming operation starts so that whether the driving motor has started driving is determined. If the driving motor starts driving (Yes in step 1), the pulse signal from the driving side encoder sensor 110 is counted by the count part 101 in step 2. Similarly, the pressing roller 51 counts the pulse signal from the pressing side encoder sensor 90 by the count part 101 in step 3. Next, the paper P is conveyed to a position facing the carriage 23, so that whether the conveyance belt 31 stops driving is determined in step 4. If the driving of the conveyance belt 31 is stopped (Yes in step 4), the count number of the driving roller 32 and the count number of the pressing number 51 are compared by the comparison part 102. Whether the count number of the driving roller 32 is equal to the count number of the pressing number 5 is determined in step 5. In a case where the count number of the driving roller 32 is different from the count number of the pressing number 5 (No in step 5), the slip is generated between the conveyance belt 31 and the driving roller 32 and therefore the image forming starting position of the paper does not reach the position facing the head 9, and therefore the process in step 6 is implemented. In step 6, the driving roller 32 is rotated at the difference number between the count number of the driving roller 32 and the count number of the pressing roller 51. More specifically, the pulse signal being output from the encoder sensor 110 at the driving roller side is counted. When this count number is equal to the difference between the count number of the driving roller 32 and the count number of the pressing roller 51, the driving of the driving roller stops. As a result of this, the image forming starting position of the paper faces the head 9. After the image forming starting position of the paper faces the head 9, the carriage 23 is driven so that the image is formed on the paper in step 7. On the other hand, if the count number of the driving roller 32 is equal to the count number of the pressing roller 51 (Yes in step 5), the slip of the belt is not generated during the conveyance of the paper. Therefore, the image forming starting position of the paper is conveyed to the position facing the head 9. In this case, the carriage 23 is driven so that the image is formed on the paper in step 7.

As discussed above, the amount of slip of the conveyance belt 31 is detected so that the gap (shift) of the image forming starting position is corrected based on the detected result. Because of this, it is possible to convey the paper P carried by the conveyance belt 31 to the image forming position at good precision. In addition, in this embodiment, the amount of slip of the conveyance belt 31 may be detected so that the pressing force of the pressure roller 51 is controlled based on the detected result.

Figure 12:
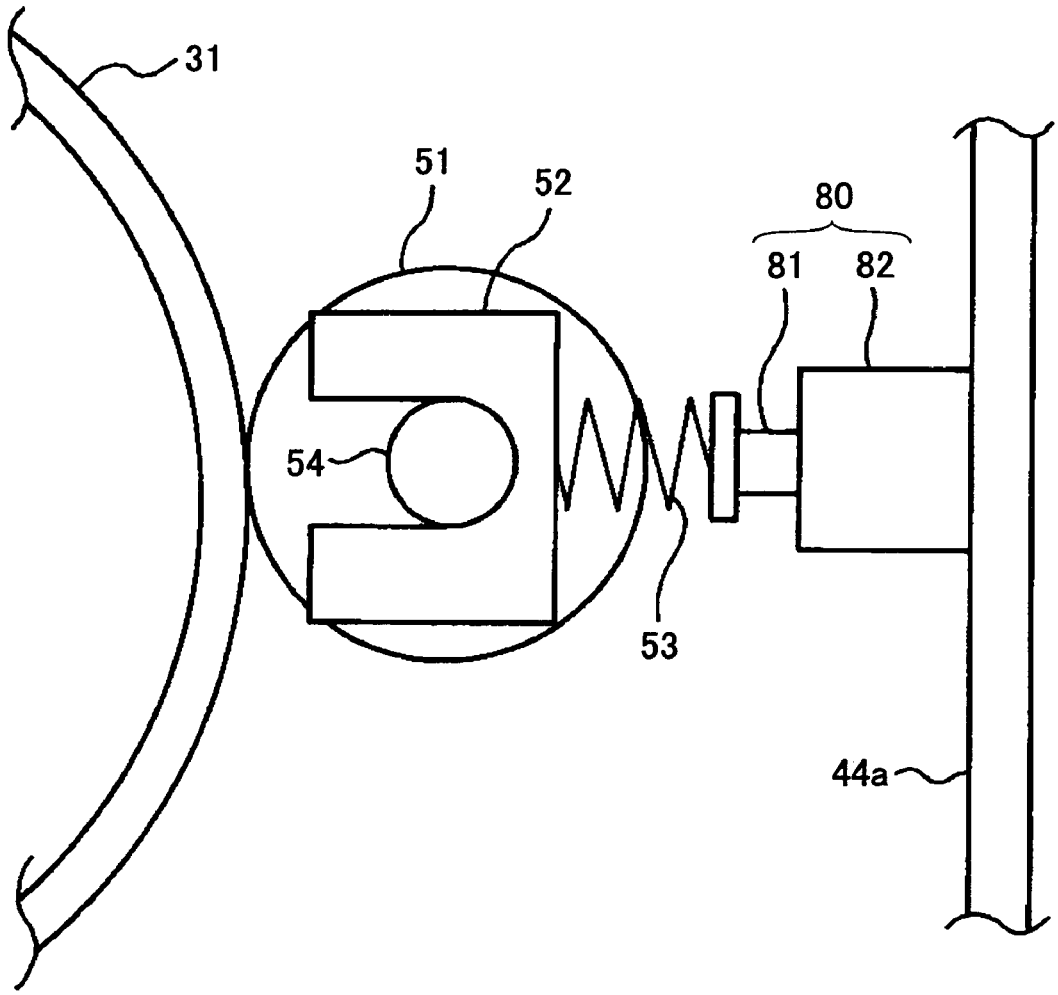
FIG. 12 is a schematic view showing a pressing part having a pressure adjusting mechanism.

In this case, for example, as shown in FIG. 12, a pressure adjusting mechanism 80 formed by an electromagnetic solenoid 82 and a plunger 81 is provided at the supporting plate 44*a* so that an end of the spring 53 is supported by the plunger 81. The electromagnetic solenoid 82 is electrically connected to the pressure control part 107. The plunger 81 moves by a control electrical current from the pressing control part 107 so as to advance from and retract to the electromagnetic solenoid 82, and thereby a compressed length of the spring 53 is changed. Because of this, the pressing force of the pressing roller 51 is adjusted.

Figure 13:
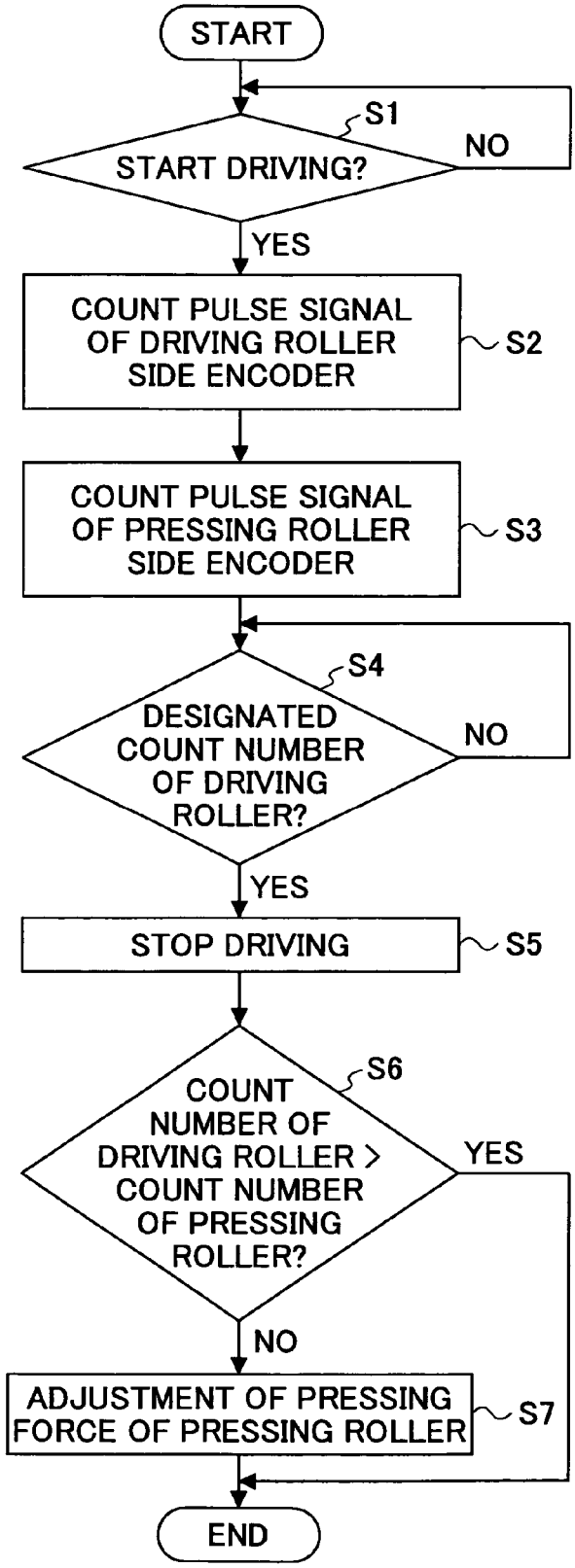
FIG. 13 is a flowchart of a pressing force control.
Figure 14:
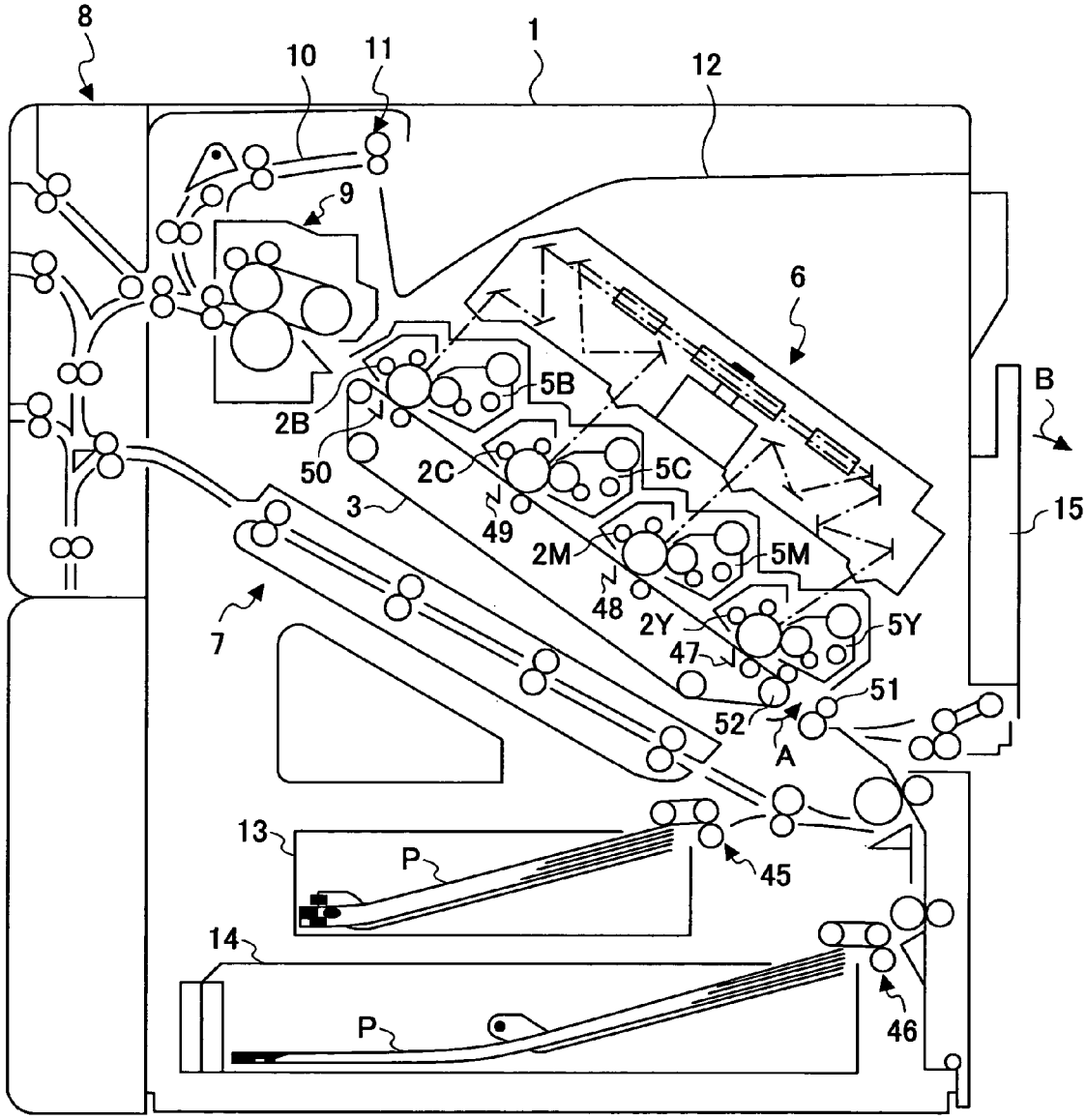
FIG. 14 is a schematic structural view showing a tandem type image forming apparatus.

FIG. 13 a flowchart of a pressing force control process. As shown in FIG. 13, in step 1, whether the conveyance belt 31 starts driving is determined. If the conveyance belt 31 starts driving (Yes in step 1), the pulse signal from the driving roller side encoder sensor 110 is counted by the count part 101 in step 2. In addition, the count part 101 counts the pulse signal from the pressing side encoder sensor 90 in step 3. Next, whether the pulse signal from the driving roller side encoder sensor 110 is equal to the designated count number is determined in step 4. If the pulse signal from the driving roller side encoder sensor 110 is equal to the designated count number, the driving is stopped in step 5 and whether the pulse signal from the pressing side encoder sensor 90 is equal to the designated count number is determined in step 6. In a case where the pulse signal from the pressing side encoder sensor 90 is not equal to the designated count number (No in step 6), since the slip of the conveyance belt 31 is generated, the pressing force of the pressing roller 51 is adjusted in step 7. More specifically, the pressing force based on the count number is read out from the pressing table stored in the storage part 103. Based on the pressing force, the pressing control part 107 changes the control electrical current of the electromagnetic solenoid 82. As a result of this, the plunger 81 moves to the left side at a designated amount so that the compression amount of the spring 53 is increased. Because of this, the pressing force of the pressing roller 51 applied to the belt 31 is increased so that the slippage between the conveyance belt 31 and the driving roller 32 is prevented from being generated. On the other hand, in a case where the count number of the driving roller 32 is equal to the count number of the pressing roller 51, the slip of the belt is not generated. Therefore, the process ends without changing the pressing force of the pressing roller 51.

As discussed above, the slip of the belt can be securely prevented by detecting the amount of the slip of the belt and adjusting the pressing force of the pressing roller 51 applied to the belt based on the detection result.

The present invention is not limited to the above-discussed embodiments, but variations and modifications may be made without departing from the scope of the present invention.

For example, although the inkjet type image forming apparatus is discussed in this embodiment, the present invention is not limited to this. For example, the present invention can be applied to a tandem type image forming apparatus wherein transferring is made by stacking (superposing) the toner images on the paper carried by the conveyance belt. In this tandem type image forming apparatus, if the conveyance belt is slipped against the driving roller, the position shift of the image is generated. However, by using the pressing part 50 of this embodiment to the conveyance belt, it is possible to prevent the conveyance belt from being slipped against the driving roller. Therefore, the position shift of the image can be prevented.

Thus, the embodiment of the present invention provides an image forming apparatus, including:

a conveyance belt stretched around a plurality of rollers and carrying and conveying a recording medium to the image forming apparatus, at least one roller of the plural rollers being a driving roller rotationally driving the conveyance belt; and a pressing part configured to come in contact with the conveyance belt in an area where a surface of the conveyance belt moves, different from a conveyance area where the recording medium is carried, and configured to press the conveyance belt to the driving roller side so that the conveyance belt does not slip against the driving roller.

According to the above-mentioned image forming apparatus, since the conveyance belt is pressed to the driving roller side by the pressing roller as the pressing member, the slippage between the conveyance belt and the driving roller is not generated. Therefore, it is possible to convey the paper as the recording medium in the image forming apparatus.

In addition, the pressing roller comes in contact with the conveyance belt in an area different from the conveyance area where the recording medium is carried on the surface of the conveyance belt. Therefore, it is possible to prevent the difficulty that the paper carried by the conveyance belt passes between the pressing roller and the conveyance belt so that paper jamming can be prevented.

The image forming apparatus may further include:

a guide member configured to guide the recording medium conveyed to the conveyance belt;

wherein the pressing member is supported by the guide member.

In the above-mentioned image forming apparatus, since the pressing roller is supported by a lower guide as the guide member, it is not necessary to separately provide a mechanism for supporting the pressing roller.

The image forming apparatus as claimed in claim 1; may further include:

a charging member configured to electrostatically charge the conveyance belt;

wherein the charging member is provided at a downstream side in a moving direction of the conveyance belt further than the pressing part and at an upstream side against the moving direction of the conveyance belt further than the conveyance area.

In the above-mentioned image forming apparatus, since the charging roller as the charging member is provided at the downstream side in a moving direction of the conveyance belt further than the pressing part and at the upstream side in the moving direction of the conveyance belt further than the conveyance area, an electric charge applied to the conveyance belt by the charging roller is not removed by the pressing roller. Because of this, as compared with a structure where the pressing roller is provided at the upstream side in the moving direction of the conveyance belt further than the charging roller, it is possible to electrostatically adhere the paper well.

The pressing part may come in contact with a center part in a width direction of the conveyance belt.

In a case where the pressing roller evenly comes in contact with the belt in the belt width direction, the distance between one end and the other end where the pressing rollers comes in contact with the conveyance belt is long. As a result of this, if there is de-centering in the rotational shaft of the pressing roller due to assembly precision or parts precision, a pressing force of the pressing roller at one end side to the conveyance belt is extremely different from a pressing force of the pressing roller at the other end side to the conveyance belt, so that the conveyance belt is twisted toward a part having a high pressing force. However, by concentrating the area where the pressing rollers come in contact with the center part of the conveyance belt like this embodiment, the distance between one end and the other end where the pressing rollers come in contact with the conveyance belt is shorter than the distance in the case where the pressing rollers evenly come in contact with the belt in the belt width direction. Therefore, even if there is de-centering at the rotational shaft of the pressing roller, the difference between the pressing forces to the conveyance belt of the pressing roller at one end side and the pressing forces to the conveyance belt of the pressing roller at the other end side is smaller than the difference in the case where the pressing roller evenly comes in contact with the belt in the belt width direction. As a result of this, the generation of the twist of the conveyance belt can be prevented.

The pressing member may come in contact with the conveyance belt in a area equal to or greater than 15 mm and equal to or less than 50 mm from the center of the width direction of the conveyance belt toward ends of the conveyance belt.

In the above-mentioned image forming apparatus, the pressing roller comes in contact with the conveyance belt in a area B equal to or greater than 15 mm and equal to or less than 50 mm from the center of the width direction of the conveyance belt toward ends of the conveyance belt. As long as the pressing roller is provided within the above-mentioned area, even if the rotational shaft of the pressing roller is de-centered, the pressing force at one end of the pressing roller is not extremely different from the pressing force at the other end of the pressing roller. Therefore, it is possible to prevent the twist of the conveyance belt.

The charging member may come in contact with the conveyance belt;

the image forming apparatus has a pushing member configured to come in contact with the conveyance belt so that the recording medium conveyed to the conveyance belt is pushed by the conveyance belt; and the pressing force of the pressing part applied to the conveyance belt is greater than a pressing force of the charging member applied to the conveyance belt and greater than a pushing force of the pushing member applied to the conveyance belt.

In the above-mentioned image forming apparatus, the pressing force of the pressing roller to the conveyance belt is greater than the pressing force of the charging roller as the charging member to the conveyance belt and a pushing force of the pushing roller as the pushing member to the conveyance belt. If the pressing force of the pressing roller applied to the conveyance belt is smaller than the charging roller or the pushing roller, the slippage between the driving roller and the conveyance belt cannot be prevented by the pressing roller. If the pressing force of the pushing roller to the conveyance belt is greater than the pressing force of the pressing roller, it may be difficult for the conveyed paper P to pass through between the pushing roller and the conveyance belt so that the paper jamming may be generated. If the pressing force of the charging roller to the conveyance belt is greater that the pressing force of the pressing roller, the conveyance belt cannot be charged well depending on a material quality of the conveyance belt. As discussed above, in a case where the pressing force of the pressing roller to the conveyance belt is greater than the pressing forces of the charging roller and the pushing roller, it is possible to prevent the slippage between the driving roller and the conveyance belt without damaging the charging properties of the conveyance belt or generation of the paper jamming.

The pressing part may have a roller shaped-configuration and rotates with the conveyance belt; and the image forming apparatus may have a measuring part configured to compare an external circumferential surface moving distance of the pressing part and an external circumferential moving distance of the driving roller so that the amount of the slippage between the conveyance belt and the driving roller is determined.

In the above-mentioned image forming apparatus, if the slippage between the driving roller and the conveyance belt is generated, the external circumferential surface moving distance of the pressing roller rotating with the conveyance belt is shorter than the external circumferential moving distance of the driving roller. Therefore, the reduced amount of the external circumferential surface moving distance of the pressing roller is measured as an amount of the slippage between the driving roller and the conveyance belt. Thus, by measuring the amount of the slippage between the driving roller and the conveyance belt, based on the measured result, it is possible to detect whether the paper carried by the belt can be conveyed to the position facing the head at the good precision. Furthermore, based on the measured result, it is possible to detect whether the pressing force of the pressing roller applied to the conveyance belt is equal to the pressing force whereby the slippage between the driving roller and the conveyance belt is not generated.

The image forming apparatus may further include a driving control part configured to control driving of the driving roller based on a measuring result by the measuring part.

In the above-mentioned image forming apparatus, the belt is moved by implementing driving-control at the amount of the slip measured by the measuring part so that it is possible to convey the paper carried by the belt to the image forming apparatus at a good precision even if the slippage between the conveyance belt and the driving roller is generated.

The image forming apparatus may further include a press control part configured to control a pressing force of the pressing part applied to the conveyance belt based on a measuring result by the measuring part.

In the above-mentioned image forming apparatus, the pressing force of the pressing roller applied to the conveyance belt is controlled so as to be increased by the amount of the slip measured by the measuring part so that it is possible to press the conveyance belt by a pressing force proper for not generating the slippage between the driving roller and the belt. Hence, it is possible to securely prevent the slippage between the conveyance belt and the driving roller.

The image forming apparatus may further include a head part having a jet opening configure to jet ink. An image may be formed on the recording medium by ink jetted from the head part.

In the above-mentioned image forming apparatus, since it is possible to convey the paper to the image forming apparatus at good precision, it is possible to form a high quality image without the reaching position of the ink on the paper being shifted.

At least one roller of the plural rollers stretching the conveyance belt may be a tension roller that is energized in a direction so that tension is provided to the conveyance belt.

In the above-mentioned image forming apparatus, it is possible to prevent the reduction of the stretch force of the conveyance belt and the generation of the slippage between the conveyance belt and the driving roller.

This patent application is based on Japanese Priority Patent Application No. 2005-36142 filed on Feb. 14, 2005, the entire contents of which are hereby incorporated by reference.

What is claimed is:

1. An image forming apparatus, comprising:

a paper feeding part situated at a lower part of the image forming apparatus;

a lower guide member and an upper guide member configured to change a conveyance direction of a recording medium fed upward by the paper feeding part to a substantially horizontal direction, the lower guide member having a curved portion and a substantially vertical surface provided substantially vertically;

a conveyance belt stretched around a plurality of rollers and carrying and conveying a recording medium to the image forming apparatus, at least one roller of the plural rollers being a driving roller rotationally driving the conveyance belt;

a pressing part configured to come in contact with the conveyance belt in an area where a surface of the conveyance belt moves, different from a conveyance area where the recording medium is carried, and configured to press the conveyance belt to the driving roller side so that the conveyance belt does not slip against the driving roller; and a pushing roller in contact with the conveyance belt and situated above the pressing part, wherein the pressing part is provided so as not to come in contact with the recording medium, wherein the lower guide member and the upper guide member guide the recording medium so that the recording medium passes outside of the pressing part, is guided to a portion where the conveyance belt and the pushing roller come in contact with each other, and does not pass a portion where the conveyance belt and the pressing part come into contact with each other, and wherein the pressing part is supported by the vertical surface of the lower guide member and is pressed by a spring in a horizontal direction from the vertical surface to the pressing roller.

2. The image forming apparatus as claimed in claim 1; further comprising:

a guide member configured to guide the recording medium conveyed to the conveyance belt;

wherein the pressing member is supported by the guide member.

3. The image forming apparatus as claimed in claim 1; further comprising:

a charging member configured to electrostatically charge the conveyance belt;

wherein the charging member is provided at a downstream side in a moving direction of the conveyance belt further than the pressing part and at an upstream side against the moving direction of the conveyance belt further than the conveyance area.

4. The image forming apparatus as claimed in claim 3;

wherein the charging member comes in contact with the conveyance belt;

the image forming apparatus has a pushing member configured to come in contact with the conveyance belt so that the recording medium conveyed to the conveyance belt is pushed by the conveyance belt; and the pressing force of the pressing part applied to the conveyance belt is greater than a pressing force of the charging member applied to the conveyance belt and greater than a pushing force of the pushing member applied to the conveyance belt.

5. The image forming apparatus as claimed in claim 1;

wherein the pressing part comes in contact with a center part in a width direction of the conveyance belt.

6. The image forming apparatus as claimed in claim 5;

wherein the pressing member comes in contact with the conveyance belt in a area equal to or greater than 15 mm and equal to or less than 50 mm from the center of the width direction of the conveyance belt toward ends of the conveyance belt.

7. The image forming apparatus as claimed in claim 1; further comprising:

a head part having a jet opening configure to jet ink;

wherein an image is formed on the recording medium by ink jetted from the head part.

8. The image forming apparatus as claimed in claim 1;

wherein at least one roller of the plural rollers stretching the conveyance belt is a tension roller that is energized in a direction so that tension is provided to the conveyance belt.

9. The image forming apparatus as claimed in claim 1, wherein the pressing part is a pressing roller provided between a charging roller and a pushing roller in a paper conveyance direction, the charging roller is configured to electrostatically charge a surface of the conveyance belt, the pushing roller is configured to push a paper onto the conveyance belt at a position facing an upper part of the driving roller, and the paper is supplied between the pushing roller and the conveyance belt by a guide member configured to supply the paper from a paper feeding part to the conveyance belt.

10. The image forming apparatus as claimed in claim 1, wherein the pressing part is a pressing roller, a charging roller is provided between a pressing roller and a pushing roller in a paper conveyance direction, the charging roller is configured to electrostatically charge a surface of the conveyance belt, the pressing roller is configured to press the conveyance belt to the driving roller so that the conveyance belt does not slip against the driving roller, the pushing roller is configured to push a paper onto the conveyance belt at a position facing an upper part of the driving roller, and the paper is supplied between the pushing roller and the conveyance belt by a guide member configured to supply the paper from a paper feeding part to the conveyance belt.

11. The image forming apparatus as claimed in claim 1, wherein the pressing part applies a pressing force against the conveyance belt so that the conveyance belt does not slip against the driving roller, and said pressing force does pot allow a sheet of paper to pass between the pressing part and the conveyance belt.

12. An image forming apparatus, comprising:

a conveyance belt stretched around a plurality of rollers and carrying and conveying a recording medium to the image forming apparatus, at least one roller of the plural rollers being a driving roller rotationally driving the conveyance belt; and a pressing part configured to come in contact with the conveyance belt in an area where a surface of the conveyance belt moves, different from a conveyance area where the recording medium is carried, and configured to press the conveyance belt lo the driving roller side so that the conveyance belt does not slip against the driving roller wherein the pressing part has a roller shaped-configuration and rotates with the conveyance belt; and the image forming apparatus has a measuring part configured to compare an external circumferential surface moving distance of the pressing part and an external circumferential moving distance of the driving roller so that the amount of the slippage between the conveyance belt and the driving roller is determined.

13. The image forming apparatus as claimed in claim 12; further comprising:

a driving control part configured to control driving of the driving roller based on a measuring result by the measuring part.

14. The image forming apparatus as claimed in claim 12; further comprising:

a press control pan configured to control a pressing force of the pressing part applied to the conveyance belt based on a measuring result by the measuring part.

* * * * *